United States Patent [19]

Lund et al.

[11] 4,157,690

[45] Jun. 12, 1979

[54] NEEDLE BAR FOR A TUFTING MACHINE

[75] Inventors: Kenneth Lund, Accrington; Barrie Bleasdale, Oswaldtwistle, both of England

[73] Assignee: Edgar Pickering (Blackburn) Limited, Blackburn, England

[21] Appl. No.: 884,194

[22] Filed: Mar. 7, 1978

[30] Foreign Application Priority Data

Mar. 16, 1977 [GB] United Kingdom ..... 11175/77
Jan. 9, 1978 [GB] United Kingdom ..... 00761/78

[51] Int. Cl.[2] ..... D05B 55/02
[52] U.S. Cl. ..... 112/226; 112/79 R
[58] Field of Search ..... 112/79 R, 226, 79 A; 66/208, 214

[56] References Cited

U.S. PATENT DOCUMENTS

| | | | |
|---|---|---|---|
| 3,253,428 | 5/1966 | Pace | 66/214 |
| 3,485,195 | 12/1969 | Torrence | 112/79 R |
| 3,618,542 | 11/1971 | Zocker | 66/214 X |
| 3,811,298 | 3/1974 | Kohl | 66/208 |
| 3,823,581 | 7/1974 | Russo | 66/208 |
| 4,014,278 | 3/1977 | Jolley et al. | 112/226 |

FOREIGN PATENT DOCUMENTS

| | | | |
|---|---|---|---|
| 760204 | 11/1956 | United Kingdom | 112/226 |

*Primary Examiner*—Ronald Feldbaum
*Attorney, Agent, or Firm*—Watson, Cole, Grindle & Watson

[57] ABSTRACT

A needle bar assembly for a tufting machine, comprising a member having a saw tooth surface, a row of needles disposed with their shanks in the recesses of said surface and clamps for clamping the needles in the recesses.

2 Claims, 9 Drawing Figures

NEEDLE BAR FOR A TUFTING MACHINE

The conventional needle bar for a tufting machine comprises a massive bar, of rectangular cross section, conveniently 1" square, which is reciprocated vertically by push rods and is formed, at uniform pitch, with vertical throughgoing holes into which the shanks of the needles are fitted and secured in position by screws fitted onto horizontally extending throughgoing holes in the bar.

Difficulty arises, however, in the manufacture of the needle bar when the gauge of the machine, i.e. the spacing between adjacent needles, is required to be very fine, e.g. 1/16" or 1/10". In a typical case, a needle bar 172½" long may require to be drilled with no less than 1662 holes, each having a diameter of 0.08", spaced at a pitch of 0.10". Since the required drill is extremely fine, it is extremely difficult to drill these holes accurately and in the event of error the entire needle bar must be scrapped.

It is possible to mitigate this difficulty by the use of a staggered needle bar, having two rows of needles with the needles in one row pitched midway between those in the other row. This expedient is not, however, available in the case of fine gauge machines for making cut pile fabric because there is insufficient clearance between the needles in the two rows for the passage of the loopers, which catch the loops of yarn projected through the backing fabric by the needles.

The invention provides a needle bar assembly for a tufting machine, comprising a member having a saw tooth surface, a row of needles disposed with their shanks in the recesses of said surface and means for clamping the needles in said recesses. Preferably the needles are accommodated in said recesses with their shanks in abutment.

The needles are thus located in individual recesses in the saw tooth surface, which can readily be made sufficiently close together to provide a very fine machine gauge, and it is unnecessary to drill holes in a member of the assembly to accommodate the needles.

Certain embodiments of the invention will now be described in detail, by way of example, with reference to the accompanying drawings, in which.

Like reference numerals denote like parts throughout the Figures.

Figure 2:
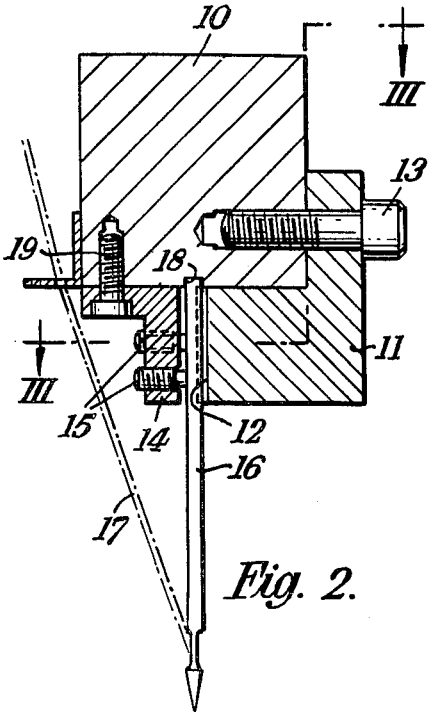
FIG. 2 is a sectional view taken substantially along line II—II of FIG. 1.
Figure 1:
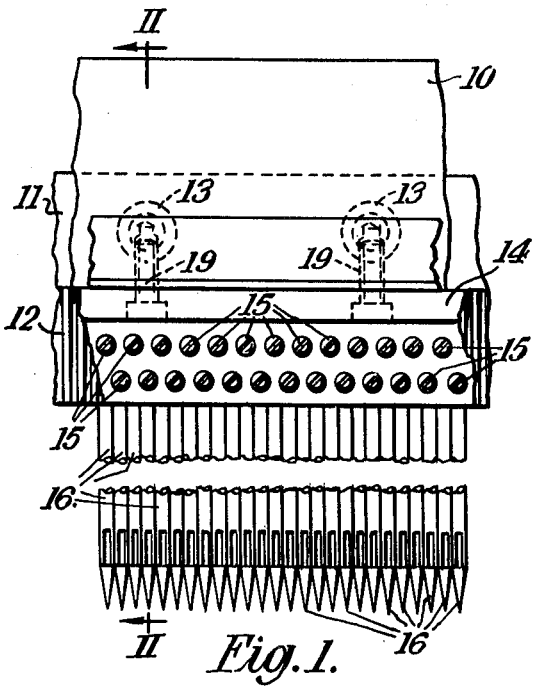
FIG. 1 is an elevational view showing part of a first embodiment of a needle bar assembly according to the invention.
Figure 3:
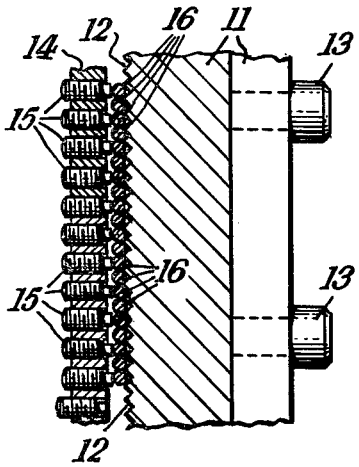
FIG. 3 is a sectional view taken substantially along line III—III of FIG. 2.

In the embodiment shown in FIGS. 1-3, the needle bar assembly includes a main bar 10 of square cross section which, when mounted in a tufting machine, is connected to push rods (not shown) which impart vertical reciprocation to the bar in conventional fashion, and carries a row of equally spaced, downwardly extending needles 16. Reciprocation of the needle bar 10 causes the needles to pierce the backing fabric and project loops of yarn 17 through the fabric.

The needle bar 10 carries at one side thereof a shoe 11 having a vertical saw tooth face 12, the recesses in which serve to locate the individual needles 16. The shoe 11 is attached to the bar 10 by screws 13. The upper ends of the needles 16 are accommodated in a locating groove 18 in the bottom face of the bar 10.

The needles 16 are retained in place by a clamping plate 14, which is secured to the bar by screws 19, which carries two rows of clamping screws 15, which engage the individual needles as shown in FIG. 3 and are arranged in staggered relationship as shown in FIG. 2. This enables a 1/16" gauge arrangement to be readily established with the shanks of the needles 16 in abutment as shown in FIG. 3, giving increased rigidity. There is no need to grind down the shanks of the needles, as in the case in a normal 1/16" gauge bar when the needle shanks have to fit into extremely fine holes in the bar.

Figure 4:
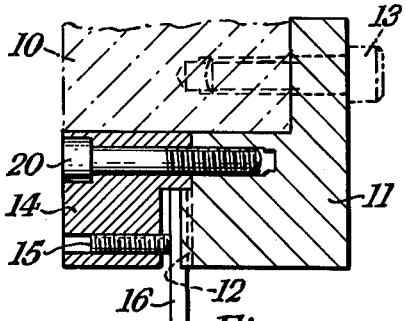
FIG. 4 is a view; similar to FIG. 2; showing a modification.
Figure 5:
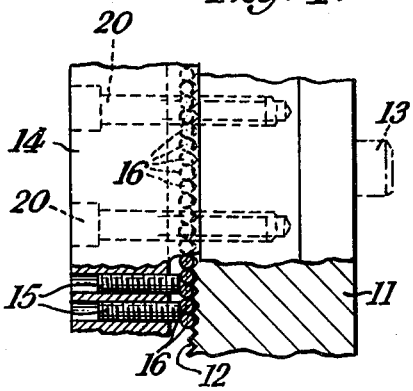
FIG. 5 is an underside plan view, partly in section, of the assembly shown in FIG. 4.
Figure 6:
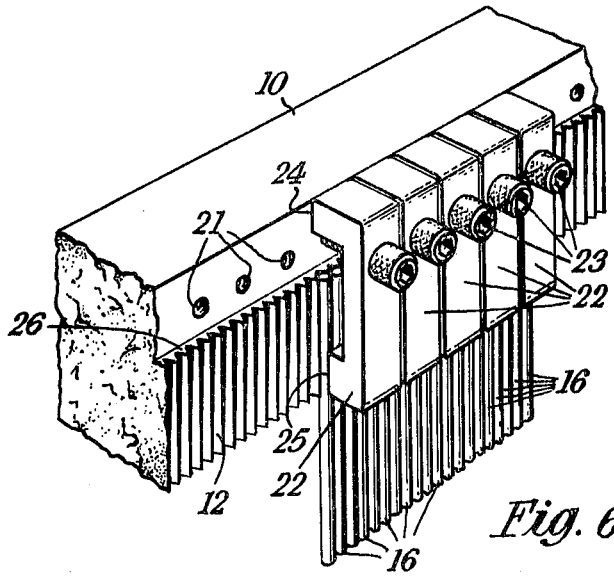
FIG. 6 is a perspective view of a part of another embodiment of a needle bar assembly according to the invention.
Figure 7:
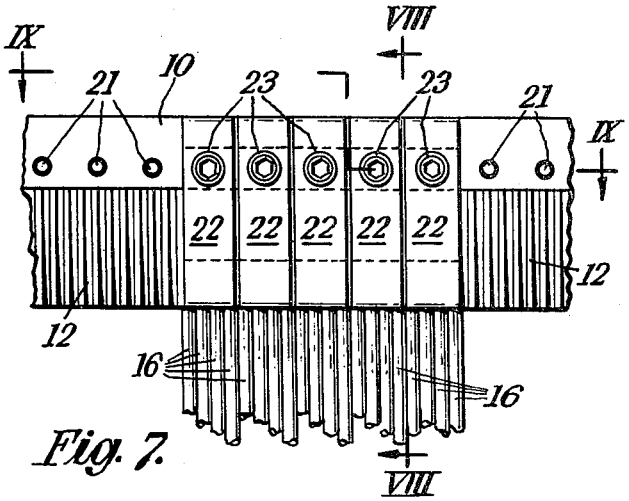
FIG. 7 is a corresponding elevational view of the FIG. 6 assembly.
Figure 8:
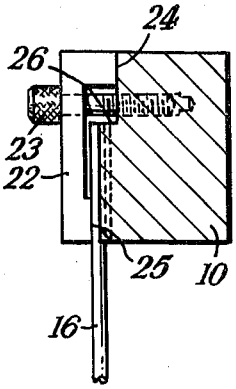
FIG. 8 is a sectional view taken substantially along line VIII—VIII of FIG. 7.
Figure 9:
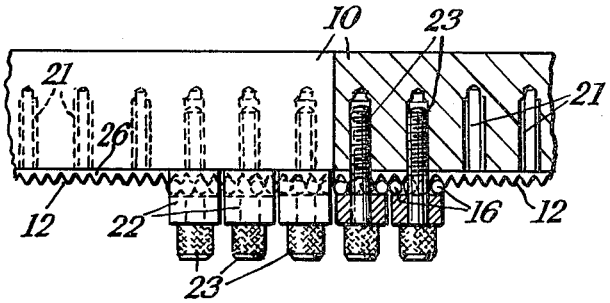
FIG. 9 is a sectional view taken substantially along line IX—IX of FIG. 7.

FIGS. 4 and 5 show a modification, in which the number of clamping screws 13 is halved by arranging for each clamping screw to clamp two needles 16. In this case the clamping plate 14 is attached to the shoe 11 by screws 20 and not to the bar 10.

While it is possible to construct the needle bar assembly of individual sections, e.g. 7" long, abutting end to end, it has been found that tightening of the screws 15 which hold the individual needles 16 in the V of recesses tend to spring the shoe and the clamping plate apart against the action of the clamping screws 19 or 20 and this can cause the needles to slip or fall out. This difficulty cannot be entirely overcome by increase in the number of clamping screws.

It can be mitigated by replacing the clamping plate 14 by a series of shorter, separate clamping plates, each of which serves to clamp a small number of needles, preferably four, and has a single clamping screw for attaching it to the shoe. This serves to provide effective clamping of the needles and has the further advantage that immediate access can be had to a broken needle by removal only of its associated clamping plate.

However, it is preferred to construct the needle bar assembly as shown in FIGS. 6-9. In this embodiment, the saw tooth surface 12 is milled in the side face of the main bar 10. As before each V recess in this surface accommodates an individual needle and the bar 10 is formed with a step 26 to allow running out of the cutter which forms the recesses and is formed, above the recesses, with a series of equally spaced tapped holes 21. The needles 16 are clamped to the bar 10 in groups of four by individual clamps 22, each of which is attached to the bar 10 by a clamping screw 23 screwed into one of the holes 21. Each clamp has an upper face 24 which abuts against the shoe and a lower face 25 which abuts against the needles 16. The face may be knurled, if desired, and flats may be provided on the needles for engagement by the face 25.

What we claim as our invention and desire to secure by Letters Patent is:

1. A needle bar assembly for a tufting machine for supporting a plurality of needles for reciprocation toward and away from a backing fabric, the assembly comprising, a main bar having an upper and a lower portion at a side surface thereof, said lower portion having downwardly extending saw teeth formed in said surface, said needles being located in adjacent recesses of said saw teeth and projecting downwardly from said main bar, threaded holes located in said upper portion at said side surface, a plurality of adjacent clamping plates for clamping a group of adjacent needles in said recesses, screws on said clamping plates aligned with said threaded holes and extending through said plates into threaded engagement with said holes, whereby said clamping plates are secured to said main bar and said needles are clamped in said recesses.

2. The needle bar assembly of claim 1, wherein each said clamping plate has a pair of spaced surfaces, one of said surfaces of each said plate abutting against said side surface at said upper portion of said main bar, and the other of said surfaces of each said plate abutting against said needles.

* * * * *